US006655602B2

(12) United States Patent
Shafer et al.

(10) Patent No.: US 6,655,602 B2
(45) Date of Patent: Dec. 2, 2003

(54) FUEL INJECTOR HAVING A HYDRAULICALLY ACTUATED CONTROL VALVE AND HYDRAULIC SYSTEM USING SAME

(75) Inventors: Scott F. Shafer, Morton, IL (US); Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 274 days.

(21) Appl. No.: 09/961,612

(22) Filed: Sep. 24, 2001

(65) Prior Publication Data

US 2003/0066898 A1 Apr. 10, 2003

(51) Int. Cl.[7] ..... F02D 1/06

(52) U.S. Cl. ..... 239/5; 239/88; 239/96; 239/585.1; 123/446; 251/30.01

(58) Field of Search ..... 239/88–96, 585.1, 239/5; 123/446, 502; 251/30.01, 30.02, 30.03

(56) References Cited

U.S. PATENT DOCUMENTS

| | | | | |
|---|---|---|---|---|
| 4,116,591 | A | | 9/1978 | Mardell |
| 4,178,137 | A | | 12/1979 | Brotherston |
| 4,667,638 | A | | 5/1987 | Igashira et al. |
| 4,699,112 | A | | 10/1987 | Filippi et al. |
| 4,753,212 | A | | 6/1988 | Miyaki et al. |
| 4,782,807 | A | | 11/1988 | Takahashi |
| 4,838,233 | A | | 6/1989 | Hayashi et al. |
| 4,898,434 | A | | 2/1990 | Kohno et al. |
| 4,986,728 | A | | 1/1991 | Fuchs |
| 5,186,151 | A | | 2/1993 | Schwerdt et al. |
| 5,669,355 | A | | 9/1997 | Gibson et al. |
| 5,682,858 | A | | 11/1997 | Chen et al. |
| 5,687,693 | A | | 11/1997 | Chen et al. |
| 5,697,342 | A | | 12/1997 | Anderson et al. |
| 5,713,520 | A | | 2/1998 | Glassey et al. |
| 5,826,562 | A | | 10/1998 | Chen et al. |
| 5,833,146 | A | | 11/1998 | Hefler |
| 6,283,441 | B1 | * | 9/2001 | Tian ..... 239/96 |
| 6,354,270 | B1 | * | 3/2002 | Shafer ..... 123/446 |
| 6,378,497 | B1 | * | 4/2002 | Keyster et al. ..... 123/446 |

* cited by examiner

*Primary Examiner*—Steven J. Ganey
(74) *Attorney, Agent, or Firm*—Liell & McNeil

(57) ABSTRACT

In some hydraulically actuated fuel injectors, a pressure communication passage extends from a pilot valve to the underside of a spool valve to control movement of the same. For the spool valve to move, a substantial amount of fluid flow past the pilot valve is required due to the relatively large amount of fluid that must be displaced by movement of the spool valve member. However, during cold start, when the oil in the pressure communication passage is relatively viscous, it is difficult to move enough fluid past the relatively small flow area through the pilot valve to allow the spool valve to advance to its upper position. Therefore, the fuel injector of the present invention includes a pressure communication passage that is connected to the underside of the spool valve to be separated from the branch that passes through the pilot valve.

20 Claims, 3 Drawing Sheets

FUEL INJECTOR HAVING A HYDRAULICALLY ACTUATED CONTROL VALVE AND HYDRAULIC SYSTEM USING SAME

TECHNICAL FIELD

This invention relates generally to hydraulic systems, and more particularly to fuel injectors having hydraulically actuated control valves.

BACKGROUND

Several recent advances have been made in the area of hydraulically actuated fuel injectors. While many of these advances have been successful, engineers are always searching for ways to improve the performance of hydraulically actuated fuel injectors. For instance, in some hydraulically actuated fuel injectors, a pressure communication passage extends from a pilot valve to the top of the needle valve member, with a branch of this passage running to the underside of a spool valve to control movement of the same. One example of a fuel injector including such a configuration is described in U.S. Pat. No. 5,833,146, issued to Hefler on Nov. 10, 1998. While this design has performed well, a substantial amount of fluid flow past the pilot valve is required to move the spool valve due to the relatively large amount of fluid that must be displaced by movement of the spool valve member.

During cold start, when the oil in the pressure communication passage is relatively viscous, it is more difficult to displace the fluid past the relatively small flow area through the pilot valve to allow the spool valve to advance to its open position. This in turn can inhibit the fuel injector from performing optimally when the actuation fluid, typically oil, is viscous at cold start. In order to alleviate this need for substantial fluid flow around the pilot valve member, and to allow the fuel injector to perform closer to optimum at cold start, it would be desirable to make it easier to evacuate fluid from the underside of the spool, particularly during cold start and other high viscosity situations.

The present invention is directed to overcoming one or more of the problems as set forth above.

SUMMARY OF THE INVENTION

In one aspect of the present invention, a valve assembly includes a valve body that defines a first passage, a second passage and a variable pressure passage. A spool valve member is positioned in the valve body and is movable between a first position in which the first passage is open to the variable pressure passage and a second position in which the second passage is open to the variable pressure passage. A spool control volume is defined by at least one of the valve body and the spool valve member. A control valve member is positioned in the valve body and is movable between an open position in which the first passage is in fluid communication with the spool control volume and a closed position in which the first passage is blocked from fluid communication with the spool control volume. The control valve member includes a hydraulic surface that defines a hydraulic force direction. A biaser is operably in contact with the control valve member to produce a biasing force in opposition to the hydraulic force direction.

In another aspect of the present invention, a hydraulically actuated device includes a device body that defines a high pressure passage, a low pressure passage and a variable pressure passage. A source of high pressure actuation fluid is connected to the high pressure passage. A low pressure reservoir is connected to the low pressure passage. A spool valve member is movably positioned in the device body. A spool control volume is defined by at least one of the device body and the spool valve member. A control valve member is movably positioned in the device body and includes a hydraulic surface that defines a hydraulic force direction. The hydraulic surface is exposed to the high pressure passage when the control valve member is in a first position and is exposed to the low pressure passage when the control valve member is in a second position. The hydraulic surface is exposed to fluid pressure in a pressure cavity that is fluidly isolated from the spool control volume. A biaser is operably in contact with the control valve member to produce a biasing force in opposition to the hydraulic force direction. A reciprocating piston is included in the hydraulic device that has a hydraulic surface exposed to fluid pressure in the variable pressure passage.

In yet another aspect of the present invention, a method of operating a control valve includes providing a valve assembly that includes a valve body which defines a low pressure passage and a high pressure passage. A pilot valve member, a control valve member and a spool valve member are included in the valve body. The pilot valve member is moved from a first position to a second position to expose a hydraulic surface of the control valve member to the low pressure passage. The control valve member is then moved to a closed position blocking a control pressure surface of the spool valve member from the high pressure passage. Next, the spool valve member is moved from a first position to a second position. The pilot valve member is then returned to the first position to expose the hydraulic surface of the control valve member to the high pressure passage. The control valve member is next moved to an open position exposing the control pressure surface of the spool valve member to the high pressure passage. The spool valve member is then moved to the first position.

DETAILED DESCRIPTION

Figure 1:
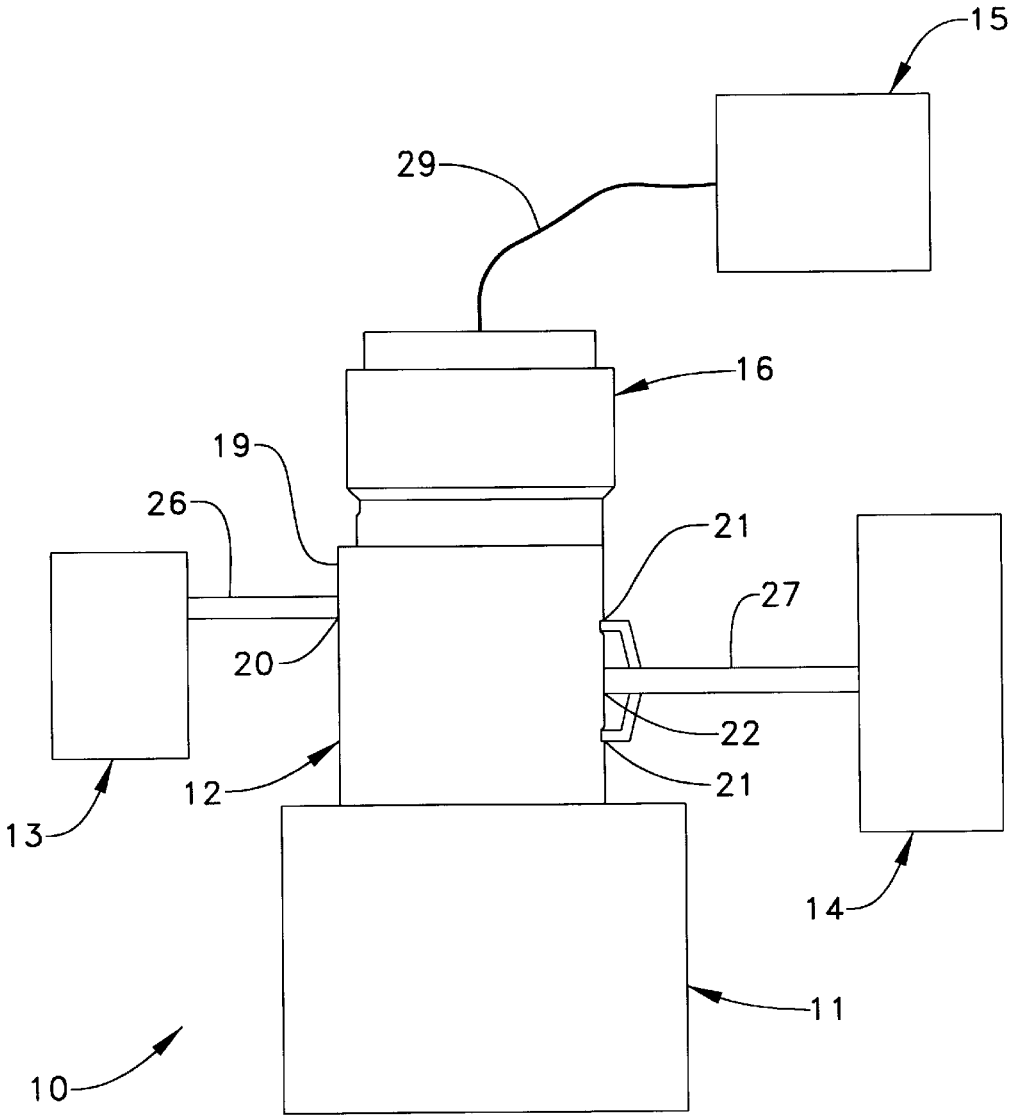
FIG. 1 is a diagrammatic representation of a hydraulic system that includes a hydraulic device according to the present invention.

Referring to FIG. 1, hydraulic system 10 includes a hydraulically-actuated device 11, such as a fuel injector or an engine valve. A control valve 12 alternately opens hydraulically-actuated device 11 to a source of high pressure fluid 13 or a low pressure fluid reservoir 14. The state of control valve 12 is controlled by energizing and de-energizing an electrical actuating device 16, which is preferably a solenoid but could also be another suitable device such as a piezoelectric actuator. Electrical actuating device 16 is controlled in its operation by a conventional electronic control module 15 via communication line 29.

Control valve 12 includes a valve body 19 that defines a high pressure inlet 20 that is connected to the source of high pressure fluid 13 via a high pressure supply line 26. In this embodiment, valve body 19 also defines a pair of low pressure vents 21 and a low pressure drain 22. These three low pressure openings communicate with low pressure fluid reservoir 14 via a low pressure passage 27.

Figure 2:
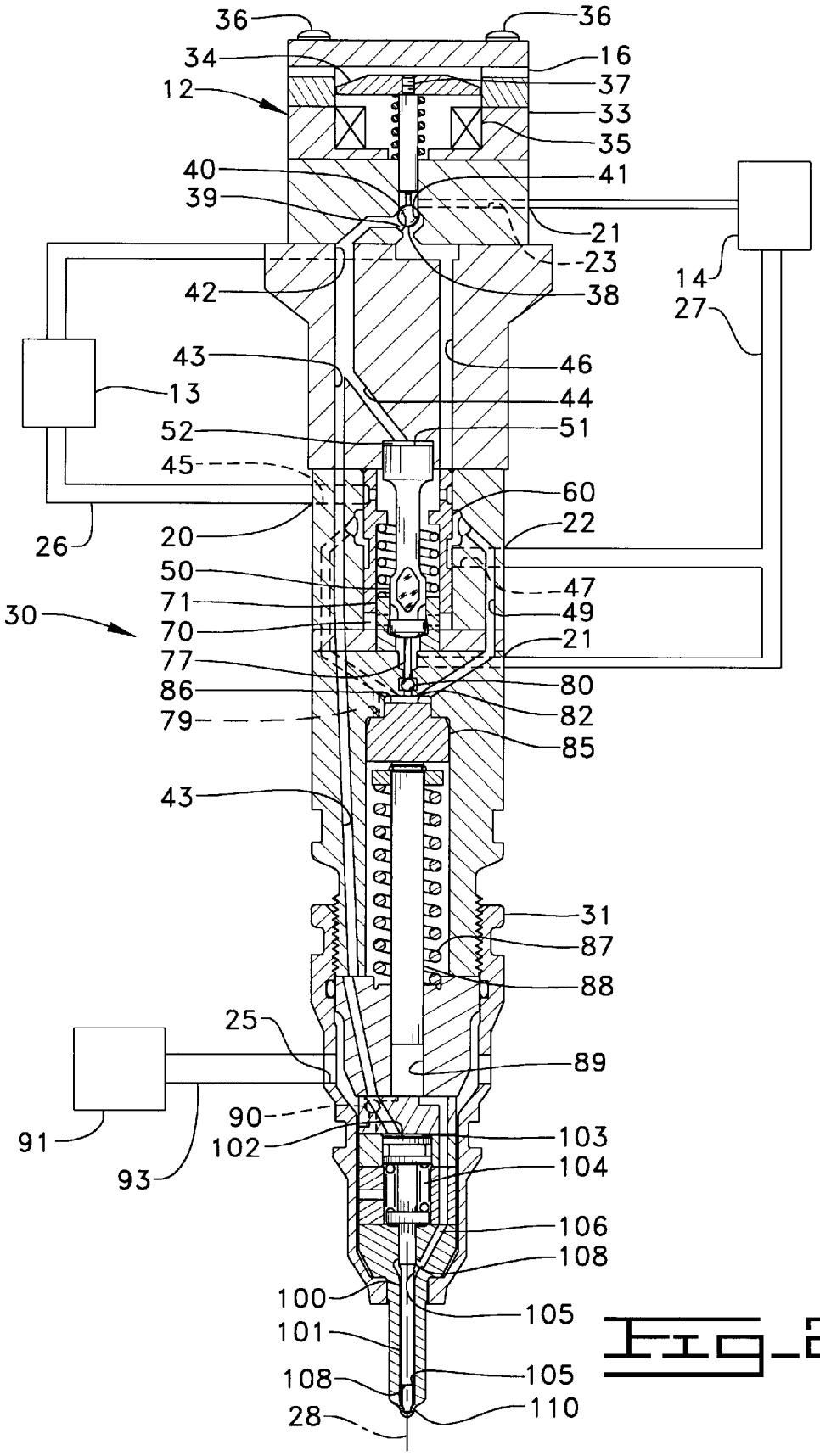
FIG. 2 is a diagrammatic representation of hydraulically-actuated electronically-controlled fuel injector according to the present invention.
Figure 3:
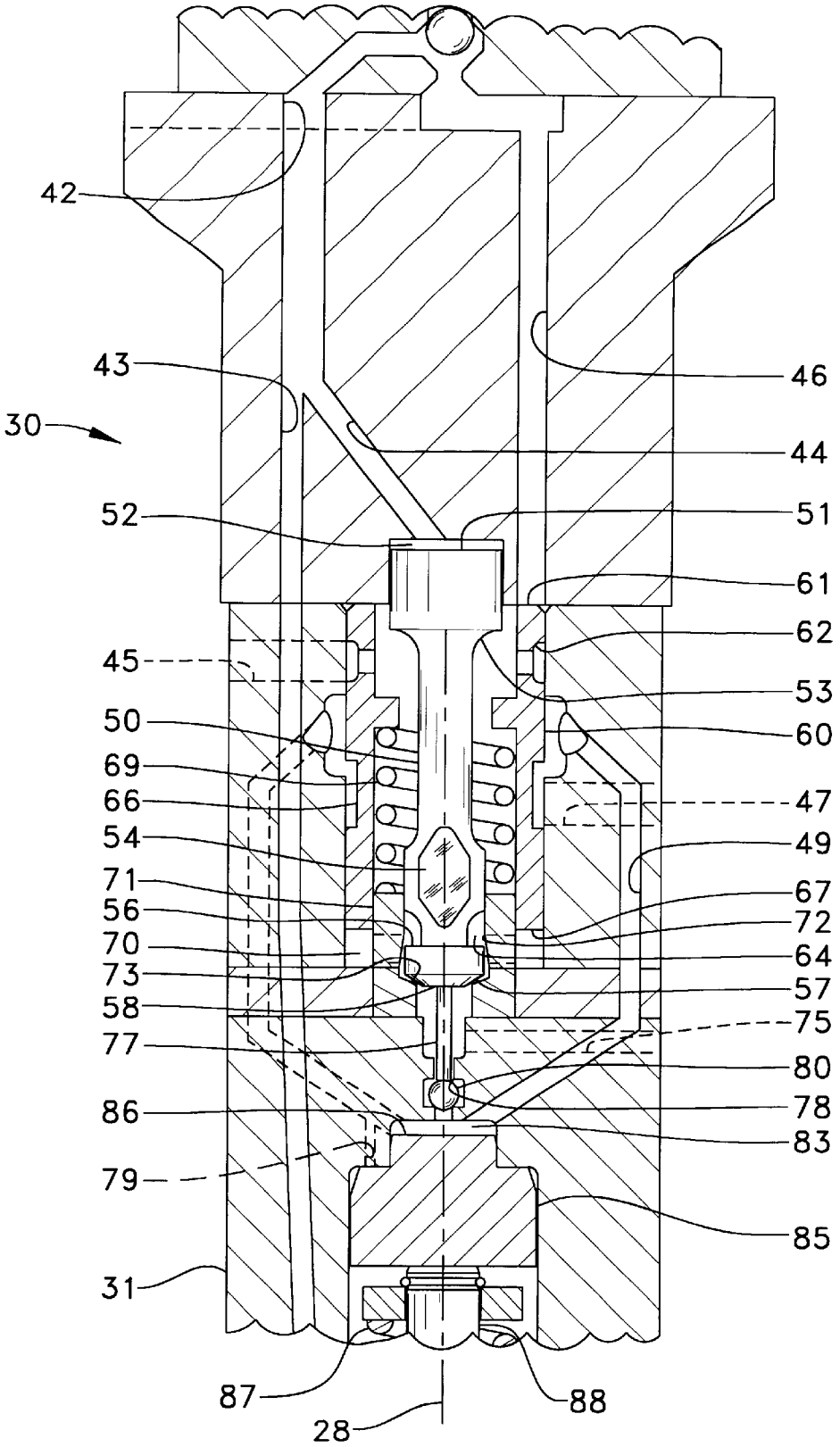
FIG. 3 is a sectioned side view of the spool valve assembly portion of the fuel injector of FIG. 2.

Referring to FIGS. 2 and 3 there is shown a diagrammatic sectioned side view of a hydraulically-actuated electronically-controlled fuel injector 30 according to the present invention. Fuel injector 30 includes an injector body 31 made up of various components that are attached to one another in a manner well known in the art and a substantial number of internal movable components positioned as they would be just prior to an injection event. Actuation fluid, which is preferably high pressure oil, can flow into a high pressure actuation fluid passage 46 that is defined by injector body 31 via an actuation fluid inlet 20 and high pressure supply line 26 from the source of high pressure fluid 13. At the end of an injection event, actuation fluid can flow out of a low pressure passage 23 that is defined by injector body 31 via an actuation fluid vent 21 into low pressure fluid reservoir 14. While a number of different fluids could be used as actuation fluid, the present invention preferably utilizes engine lubricating oil.

Fuel injector 30 is controlled in operation by a control valve 12 that includes an electrical actuator 16 which is preferably a solenoid 33, but could also be another suitable device such as a piezoelectric actuator. Control valve 12 is positioned in injector body 31 and attached by fasteners 36, which are preferably bolts but could be another suitable attachment device. Solenoid 33 includes a coil 35, an armature 34 and a pin 37 that is operably coupled to a pilot valve member 38. Pilot valve member 38 is preferably a ball valve member and is moveable within injector body 31 between a first position in which it closes a low pressure seat 41 and a second position in which it closes a high pressure seat 40. While pilot valve member 38 has been shown as a ball valve member, it should be appreciated that it could instead be a spool valve member, poppet valve member, or another suitable device. Injector body 31 also defines a pressure communication passage 42 that opens into a control volume 39 between low pressure seat 41 and high pressure seat 40. Prior to an injection event when solenoid 33 is de-energized, pilot valve member 38 is positioned in its first position to close low pressure seat 41, as shown. When pilot valve member 38 is in this position pressure communication passage 42 is open to high pressure actuation fluid supply passage 46 via control volume 39 and blocked from fluid communication with low pressure passage 23. When solenoid 33 is energized, armature 34 pushes pin 37 downward to move pilot valve member 38 toward its second position to close high pressure seat 40. When pilot valve member 38 is in the second position, pressure communication passage 42 is closed to high pressure actuation fluid supply passage 46 and open to low pressure passage 23 via control volume 39.

Pressure communication passage 42 includes a first branch passage 43 that is fluidly connected to a needle control chamber 103 and a second branch passage 44 that is in fluid communication with a pressure cavity 52. Pressure cavity 52 is defined in part by injector body 31 and a control valve member 50. Control valve member 50 is positioned within injector body 31 and is movable between an open position and a closed position. Control valve member 50 includes a hydraulic surface 51 that is exposed to fluid pressure in pressure cavity 52. When solenoid 33 is de-energized, and pilot valve member 38 is positioned in its first position closing low pressure seat 41, pressure communication passage 42 is open to high pressure passage 45 and hydraulic surface 51 is exposed to high pressure in second branch passage 44 via pressure cavity 52. When solenoid 33 is energized and pilot valve member 38 is moved to its second position to close high pressure seat 40, pressure communication passage 42 is open to low pressure passage 47 and hydraulic surface 51 is exposed to low pressure in second branch passage 44 via pressure cavity 52.

Control valve member 50 also includes a high pressure surface 53 that is continuously exposed to high pressure in high pressure passage 45. Control valve member 50 is biased toward its upward closed position by the continuous hydraulic force produced by the high pressure fluid in high pressure passage 45 that acts on high pressure surface 53. This force direction is in opposition to a hydraulic force direction defined by hydraulic surface 51. However, because high pressure surface 53 has a smaller effective area than hydraulic surface 51, the hydraulic force acting on hydraulic surface 51 is sufficient to move control valve member 50 toward its downward open position against the hydraulic force acting on high pressure surface 53 when pressure cavity 52 is in fluid communication with high pressure passage 45. While the present invention has been shown using a hydraulic biaser for control valve member 50, it should be appreciated that a mechanical biaser, such as a biasing spring, or a combination of hydraulic and mechanical biasers could be substituted for use in the present invention.

At least one flat surface 54 is machined on control valve member 50 to form a flow path 64 between high pressure passage 45 and spool control volume 70. When control valve member 50 is in its closed position, a first valve surface 56 closes a valve seat 72 that is defined by injector body 31 and blocks flow path 64 and high pressure passage 45 from fluid communication with spool control volume 70. When control valve member 50 is in its open position, first valve surface 56 is out of contact with valve seat 72 and flow path 64 fluidly connects high pressure passage 45 to spool control volume 70.

Control valve member 50 includes a conical valve surface 57 and is guided in part by a sleeve 71 that is positioned within injector body 31. When control valve member 50 is in its closed, upward position, conical valve surface 57 is out of contact with a conical valve seat 73 that is defined by sleeve 71. When control valve member 50 is in this position, a spool control volume 70 is open to low pressure vent 21 via a pressure relief passage 75. Spool control volume 70 is preferably defined by at least one of injector body 31 and a spool valve member 60 and is fluidly isolated from pressure cavity 52. When control valve member 50 is in its open, downward position, conical valve seat 73 is closed by conical valve surface 57 and fluid communication between spool control volume 70 and pressure relief passage 75 is blocked.

Control valve member 50 is preferably positioned at least partially within spool valve member 60, which is movably positioned in injector body 31. Spool valve member 60 includes a control pressure surface 67 that is exposed to pressure in spool control volume 70. A high pressure surface 61 is also included on spool valve member 60 that is continuously exposed to high pressure in high pressure actuation fluid supply passage 46. Control pressure surface 67 and high pressure surface 61 are preferably sized to have equal effective areas such that when spool control volume 70 is fluidly connected to high pressure passage 45, spool valve member 60 is hydraulically balanced and biased toward its second position only by the action of a biasing spring 69.

Also included on spool valve member 60 are a high pressure annulus 62 and a low pressure annulus 66. A variable pressure passage 49 defined by injector body 31 is alternately exposed to fluid pressure in high pressure passage 45 or low pressure passage 47 via high pressure annulus 62 and low pressure annulus 66 depending on the relative positioning of spool valve member 60. When spool valve member 60 is in its second position, as shown, high pressure annulus 62 is blocked from high pressure passage 45 while low pressure annulus 66 opens variable pressure passage 49 to low pressure passage 47. When spool valve member 60 is in its first position, low pressure annulus 66 is closed to block variable pressure passage 49 from fluid communication with low pressure passage 47 while high pressure annulus 62 opens variable pressure passage 49 to high pressure passage 45.

Returning now to fuel injector 30, injector body 31 also includes a reciprocating pumping element, piston 85 and plunger 88, which can move between an upward position, as shown, and a downward advanced position. Piston 85 is biased toward its upward position by a return spring 87. Connected to piston 85 is plunger 88 which is biased toward its upward position by return spring 87. Piston 85 advances due to the hydraulic pressure force exerted on a hydraulic surface 86 which is exposed to fluid pressure in actuation fluid cavity 83. With only hydraulic surface 86 exposed to high pressure in actuation fluid cavity 83, piston 85 would accelerate downward at a rate slower than it otherwise would if the full fluid pressure were acting over the complete top surface of piston 85. However, the volume above an annular top surface 82 of piston 85 is filled with fluid from variable pressure passage 49 via an auxiliary passage 79. When piston 85 begins to advance, plunger 88 advances in a corresponding fashion and acts as the hydraulic means for pressurizing fuel within a fuel pressurization chamber 89 that is connected to a fuel inlet 25 past a ball check valve 90. Fuel inlet 25 is connected to a source of fuel 91 via a fuel supply passage 93. When plunger 88 is returning to its upward position, fuel is drawn into fuel pressurization chamber 89 past check valve 90. During an injection event as plunger 88 moves toward its downward position, check valve 90 is closed and plunger 88 can act to compress fuel within fuel pressurization chamber 89. Fuel pressurization chamber 89 is fluidly connected to a nozzle outlet 110 via a nozzle supply passage 106.

A pressure relief valve 80 is movably positioned in injector body 31 to vent pressure spikes from actuation fluid cavity 83. Pressure spikes can be created when piston 85 and plunger 88 abruptly stop their downward movement due to the abrupt closure of nozzle outlet 110. Because pressure spikes can sometimes cause an uncontrolled and undesirable secondary injection due to an interaction of components and passageways over a brief instant after main injection has ended, pressure relief passage 75 extends between actuation fluid cavity 83 and low pressure vent 21. When control valve member 50 is in its open position, such as between injection events, a pin 77 holds pressure relief valve 80 downward to open a seat 78. When pressure relief valve 80 is in this position, actuation fluid cavity 83 is open to pressure relief passage 75 and pressure can build within actuation fluid cavity 83 in preparation for an injection event. When control valve member 50 is away from its open position, such as during an injection event, pressure relief valve 80 can act against pin 77 under the action of high pressure oil in actuation fluid cavity 83 to close seat 78 and allow high pressure oil within actuation fluid cavity 83 to be vented to pressure relief passage 75.

Returning to fuel injector 30, a direct control needle valve 100 is positioned in injector body 31 and includes a needle valve member 101 that is movable between a first position, in which nozzle outlet 110 is open, and a downward second position in which nozzle outlet 110 is blocked. Needle valve member 101 is mechanically biased toward its downward closed position by a biasing spring 104. Needle valve member 101 includes opening hydraulic surfaces 108 that are exposed to fluid pressure within a nozzle chamber 105 and a closing hydraulic surface 102 that is exposed to fluid pressure within a needle control chamber 103. As illustrated in FIG. 2, nozzle chamber 105 is fluidly isolated from spool control volume 70, while needle control chamber 103 is in fluid communication with first branch passage 43 of pressure communication passage 42. Therefore, closing hydraulic surface 102 is exposed to high pressure passage 45 when solenoid 33 is de-energized and pilot valve member 38 is positioned to close low pressure seat 41. Similarly, closing hydraulic surface 102 is exposed to low pressure passage 47 when solenoid 33 is energized and pilot valve member 38 is positioned to close high pressure seat 40.

Closing hydraulic surface 102 and opening hydraulic surfaces 108 are sized such that even when a valve opening pressure is attained in nozzle chamber 105, needle valve member 101 will not move against the action of biasing spring 104 when needle control chamber 103 is exposed to high pressure in first branch passage 43. In a similar manner, once solenoid 33 is de-energized at the end of an injection event, the high pressure in needle control chamber 103 will act to quickly move needle valve member 101 to close nozzle outlet 110 and end the injection event. Additionally, because closing hydraulic surface 102 has a larger effective area than opening hydraulic surfaces 108, once solenoid 33 is de-energized, the high pressure acting on closing hydraulic surface 102 will prevent needle valve member 101 from re-opening nozzle outlet 110 and injecting additional fuel into the combustion space. However, it should be appreciated that the relative sizes of closing hydraulic surface 102 and opening hydraulic surfaces 108 and the strength of biasing spring 104 should be such that when closing hydraulic surface 102 is exposed to low pressure in pressure communication passage 42, the high pressure acting on opening hydraulic surfaces 108 should be sufficient to move needle valve member 101 upward against the force of biasing spring 104 to open nozzle outlet 110.

INDUSTRIAL APPLICABILITY

Prior to the start of an injection event, low pressure in fuel pressurization chamber 89 prevails, plunger 88 is in its retracted position, pilot valve member 38 is positioned to close low pressure seat 40 by the force of high pressure fluid in high pressure actuation fluid supply passage 46 and needle valve member 101 is in its biased position closing nozzle outlet 110. Spool control volume 70 is in fluid communication with high pressure passage 45 via flow path 64 and actuation fluid cavity 83 is in fluid communication with low pressure passage 47 via variable pressure passage 49. Control valve member 50 is hydraulically biased toward its open position by the high pressure in first branch passage 44 which is acting on hydraulic surface 51 in pressure cavity 52. Spool valve member 60 is hydraulically balanced and biased toward its second position by biasing spring 69. Recall that when spool valve member 60 is in this position, control pressure surface 67 is exposed to high pressure in high pressure passage 45 via flow path 64. The injection event is initiated by activation of solenoid 33, which causes armature 34 to push pin 37 downward to move pilot valve member 38 to close high pressure seat 40.

When pilot valve member 38 closes high pressure seat 40, pressure communication passage 42, first branch passage 43 and second branch passage 44 become fluidly connected to low pressure passage 23 via control volume 39. This causes a dramatic drop in pressure in both pressure cavity 52 and in needle control chamber 103. The drop in pressure in pressure cavity 52 results in a hydraulic imbalance of the pressures acting on control valve member 50. Because low pressure is now acting on hydraulic surface 51, the high pressure acting on high pressure surface 53 is sufficient to move control valve member 50 upward toward its closed position. It should be appreciated that the amount of fluid displaced by control valve member 50 is a fraction of the fluid that must be displaced by spool valve member 70. As control valve member 50 advances, valve surface 52 closes valve seat 72, thus opening spool control volume 70 to low pressure vent 21 via pressure relief passage 75. The exposure of control pressure surface 67 to low pressure results in a hydraulic imbalance of spool valve member 60.

Because spool valve member 60 is no longer hydraulically balanced, it moves toward its downward, first position under the hydraulic force of high pressure fluid acting on high pressure surface 61 in high pressure passage 45. As spool valve member 60 moves toward its downward position, low pressure annulus 66 closes variable pressure passage 49 to low pressure passage 47. As spool valve member 60 continues to advance, high pressure annulus 62 opens variable pressure passage 49 to high pressure passage 45, thus beginning the flow of high pressure actuation fluid to actuation fluid cavity 83. Because control valve member 50 is in its upward position, ball valve member 80 is free to move upward against the action of pin 77, to close low pressure seat 78.

When actuation fluid cavity 83 becomes fluidly connected to high pressure passage 45, the high pressure acting on hydraulic surface 86 causes piston 85 to move downward against the action of biasing spring 87. Also, because variable pressure passage 49 is fluidly connected to high pressure passage 45, annular top surface 82 is exposed to high pressure via auxiliary passage 79. Recall that because control valve member 50 is in its closed position, pressure relief valve 80 is positioned to close seat 78, thus blocking actuation fluid cavity 83 from pressure relief passage 75 and allowing pressure build-up in the same. The downward movement of piston 85 results in a corresponding downward movement of plunger 88. The downward movement of plunger 88 closes check valve 90 and raises the pressure of the fuel within fuel pressurization chamber 89, nozzle supply passage 106 and nozzle chamber 105. Recall that low pressure is acting on closing hydraulic surface 102 because needle control chamber 103 is fluidly connected to low pressure passage 47 via pressure communication passage 42. The increasing pressure of the fuel within nozzle chamber 105 acts on opening hydraulic surfaces 108 of needle valve member 101. When the pressure exerted on opening hydraulic surfaces 108 exceeds a valve opening pressure, needle valve member 101 is lifted against the action of biasing spring 104, and fuel is allowed to spray into the combustion chamber from nozzle outlet 110.

Shortly before the desired amount of fuel has been injected into the combustion space, current to solenoid 33 is ended to end the injection event. Solenoid 33 is de-energized and pilot valve member 38 moves under the hydraulic force of high pressure actuation fluid in high pressure actuation fluid supply passage 46 to close low pressure seat 41 which in turn closes pressure communication passage 42 from fluid communication with low pressure passage 23 and fluidly connects it to the source of high pressure actuation fluid 13. Pressure communication passage 42 now delivers high pressure actuation fluid to both pressure cavity 52 and needle control chamber 103. The high pressure within needle control chamber 103 acts on closing hydraulic surface 102 and causes needle valve member 101 to move to its downward, closed position to close nozzle outlet 110. Also, because high pressure is now acting on hydraulic surface 51, control valve member 50 starts moving toward its downward position.

As control valve member 50 moves toward its downward position, valve surface 56 opens valve seat 72, which fluidly connects spool control volume 70 with high pressure passage 45. As control valve member 50 continues to advance, valve surface 57 closes valve seat 73, thus closing spool control volume 70 from pressure relief passage 75. During this movement, end 58 comes back into contact with pin 77, which moves ball valve member 80 to open seat 78. This allows high pressure actuation fluid in actuation fluid cavity 83 to be vented in pressure relief passage 75, thus preventing any secondary injection events.

As control valve 50 advances, spool control volume 70 opens to high pressure passage 45, and spool valve member 60 once again becomes hydraulically balanced and moves toward its upward position under the action of biasing spring 69. This upward movement allows low pressure annulus 66 to open variable pressure passage 49 to low pressure passage 47 while high pressure annulus 62 is closed, blocking high pressure passage 45 from fluid communication with the same. Variable pressure passage 49 now exposes actuation fluid cavity 83 to low pressure via low pressure passage 47.

Just prior to the opening of variable pressure passage 49 to low pressure passage 47, the downward decent of piston 85 and plunger 88 ends. Once variable pressure passage 49 is open to low pressure passage 47, hydraulic surface 86 is exposed to low pressure in actuation fluid cavity 83 and piston 85 and plunger 88 move toward their upward, biased positions under the action of biasing spring 87. This upward movement of plunger 88 relieves the pressure on fuel within fuel pressurization chamber 89 and causes a corresponding drop in pressure nozzle supply passage 106 and nozzle chamber 105.

Between injection events various components of injector body 31 begin to reset themselves in preparation for the next injection event. Because the pressure acting on piston 85 and plunger 88 has dropped, return spring 87 moves piston 85 and plunger 88 back to their retracted positions. The retracting movement of plunger 88 causes fuel from fuel inlet 25 to be pulled into fuel pressurization chamber 89 via fuel supply passage 93.

The present invention allows hydraulically actuated fuel injectors to perform more closely to expected levels by removing the need for a large volume of flow around pilot valve member 38. By rearranging the plumbing within injector body 31 to connect the high and low pressure passages to spool control volume 70 on a separate fluid circuit than that of the needle control chamber, pilot valve member 38 can function merely as a pressure switch. By utilizing a control valve member 50 that requires only a small amount of fluid flow due to the small distance that it must move, only a small amount of fluid flow past pilot valve member 38 is needed. Therefore, the present invention can allow hydraulically actuated fuel injectors to perform closer to expected even during cold start conditions when the oil is relatively viscous.

It should be understood that the above description is intended for illustrative purposes only, and is not intended to limit the scope of the present invention in any way. For instance, while the control valve member has been illustrated as being positioned within an inner diameter of the spool valve member, it should be appreciated that this is not necessary. With modifications to the various high low and variable pressure passageways, control valve member could instead be positioned outside the spool valve member and control the flow to the spool control volume. Additionally, while the spool valve member has been illustrated having hydraulic surfaces with relatively equal effective areas such that the spool valve member is hydraulically balanced when high pressure is acting on both surfaces, the present invention does not require this. In particular, these surfaces could be sized such that spool valve member is biased in one direction when high pressure is acting on both surfaces. Further, this could be exploited to remove the need for a mechanical biaser acting on the spool valve member. Finally, while the control valve member has been shown having only a hydraulic bias, it should be appreciated that a mechanical biaser could be substituted, or added to act with the hydraulic bias. Thus, those skilled in the art will appreciate that other aspects and features of the present invention can be obtained from a study of the drawings, the disclosure, and the appended claims.

What is claimed is:

1. A valve assembly comprising:

a valve body defining a first passage, a second passage and a variable pressure passage;

a spool valve member being positioned in said valve body and being movable between a first position in which said first passage is open to said variable pressure passage and a second position in which said second passage is open to said variable pressure passage;

a spool control volume being defined by at least one of said valve body and said spool valve member;

a control valve member being positioned in said valve body and being movable between an open position in which said first passage is in fluid communication with said spool control volume and a closed position in which said first passage is blocked from fluid communication with said spool control volume, and said control valve member including a hydraulic surface defining a hydraulic force direction; and a biaser operably in contact with said control valve member to produce a biasing force in opposition to said hydraulic force direction.

2. The valve assembly of claim 1 wherein said control valve member is positioned at least partially within said spool valve member.

3. The valve assembly of claim 1 wherein said spool valve member is biased toward said second position by a biasing spring.

4. The valve assembly of claim 1 wherein said control valve member includes a high pressure surface having a smaller effective area than an effective area of said hydraulic surface.

5. The valve assembly of claim 1 wherein said spool valve member includes a high pressure surface; and said high pressure surface and a control pressure surface exposed to fluid pressure in said spool control volume are oriented in opposition and have equal effective areas.

6. The valve assembly of claim 1 including a pressure relief valve positioned in said valve body.

7. The valve assembly of claim 1 including a pilot valve member being movable between a first position in which said hydraulic surface is exposed to a high pressure passage and a second position in which said hydraulic surface is exposed to a low pressure passage.

8. A hydraulically actuated device comprising:

a device body defining a high pressure passage, a low pressure passage and a variable pressure passage;

a source of high pressure actuation fluid being connected to said high pressure passage;

a low pressure reservoir being connected to said low pressure passage;

a spool valve member being movably positioned in said device body;

a spool control volume being defined by at least one of said device body and said spool valve member;

a control valve member being movably positioned in said device body and including a hydraulic surface defining a hydraulic force direction;

said hydraulic surface being exposed to said high pressure passage when said control valve member is in a first position and being exposed to said low pressure passage when said control valve member is in a second position;

said hydraulic surface being exposed to fluid pressure in a pressure cavity that is fluidly isolated from said spool control volume;

a biaser operably in contact with said control valve member to produce a biasing force in opposition to said hydraulic force direction; and a reciprocating piston having a hydraulic surface exposed to fluid pressure in said variable pressure passage.

9. The hydraulically actuated device of claim 8 wherein said spool valve member is movable between a first position in which said high pressure passage is open to said variable pressure passage and a second position in which said low pressure passage is open to said variable pressure passage.

10. The hydraulically actuated device of claim 9 wherein said control valve member is movable between an open position in which said high pressure passage is in fluid communication with said spool control volume and a closed position in which said high pressure passage is blocked from fluid communication with said spool control volume.

11. The hydraulically actuated device of claim 10 wherein said spool valve member is biased toward one of said first position and said second position by a biasing spring.

12. The hydraulically actuated device of claim 11 wherein said control valve includes a high pressure surface, said high pressure surface having a smaller effective area than an effective area of said hydraulic surface.

13. The hydraulically actuated device of claim 12 including a pilot valve member being movable between a first position in which said hydraulic surface is exposed to high pressure and a second position in which said hydraulic surface is exposed to low pressure.

14. The hydraulically actuated device of claim 13 wherein said control valve member is positioned at lest partially within said spool valve member.

15. The hydraulically actuated device of claim 14 wherein said hydraulically actuated device is a fuel injector.

16. The hydraulically actuated device of claim 15 wherein said fuel injector includes an injector body that defines a needle control chamber; and a direct control needle valve member is movably positioned in said injector body and includes a closing hydraulic surface exposed to fluid pressure in said needle control chamber.

17. A method of controlling a control valve comprising:

providing a valve assembly including a valve body defining a low pressure passage and a high pressure passage, and including a pilot valve member, a control valve member and a spool valve member;

moving said pilot valve member from a first position to a second position to expose a hydraulic surface of said control valve member to said low pressure passage;

moving said control valve member to a closed position blocking a control pressure surface of said spool valve member from said high pressure passage;

moving said spool valve member from a first position to a second position;

returning said pilot valve member to said first position to expose said hydraulic surface of said control valve member to said high pressure passage;

moving said control valve member to an open position exposing said control pressure surface of said spool valve member to said high pressure passage; and returning said spool valve member to said first position.

18. The method of claim 17 wherein an electronic actuator is operably coupled to said pilot valve member; and said step of moving said pilot valve member to said second position includes energizing said electronic actuator.

19. The method of claim 18 including a step of positioning said control valve member at least partially within said spool valve member.

20. The method of claim 19 including a step of mechanically biasing said spool valve member toward said second position.

* * * * *